US009097102B2

(12) United States Patent
Ward et al.

(10) Patent No.: US 9,097,102 B2
(45) Date of Patent: Aug. 4, 2015

(54) DOWNHOLE CORING TOOLS AND METHODS OF CORING

(71) Applicants: Richard Dan Ward, Pasadena, TX (US); Mark Milkovisch, Cypress, TX (US); Warren Askew, Houston, TX (US); Gokhan Erol, Katy, TX (US); Bo Yang, Sugar Land, TX (US); Steven E. Buchanan, Pearland, TX (US); Jean-Michel Hache, Bourg la Reine (FR); Adam Zygmunt Cygan, Sugar Land, TX (US)

(72) Inventors: Richard Dan Ward, Pasadena, TX (US); Mark Milkovisch, Cypress, TX (US); Warren Askew, Houston, TX (US); Gokhan Erol, Katy, TX (US); Bo Yang, Sugar Land, TX (US); Steven E. Buchanan, Pearland, TX (US); Jean-Michel Hache, Bourg la Reine (FR); Adam Zygmunt Cygan, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 175 days.

(21) Appl. No.: 13/631,154

(22) Filed: Sep. 28, 2012

(65) Prior Publication Data

US 2013/0081879 A1 Apr. 4, 2013

Related U.S. Application Data

(60) Provisional application No. 61/540,722, filed on Sep. 29, 2011.

(51) Int. Cl.

| | |
|---|---|
| ***E21B 10/02*** | (2006.01) |
| ***E21B 25/16*** | (2006.01) |
| ***E21B 49/06*** | (2006.01) |

(52) U.S. Cl.

CPC ..... *E21B 49/06* (2013.01); *E21B 10/02* (2013.01); *E21B 25/16* (2013.01)

(58) Field of Classification Search

CPC ..... E21B 10/02; E21B 10/06; E21B 25/00; E21B 25/16; E21B 49/06

USPC ..... 175/58, 78, 77, 94

See application file for complete search history.

(56) References Cited

U.S. PATENT DOCUMENTS

| | | | | |
|---|---|---|---|---|
| 2,032,509 | A * | 3/1936 | Shanor | 175/78 |
| 2,536,303 | A * | 1/1951 | Miller | 175/44 |
| 3,353,612 | A * | 11/1967 | Bannister | 175/6 |
| 5,411,106 | A | 5/1995 | Maissa et al. | |
| 5,667,025 | A | 9/1997 | Haessly et al. | |
| 7,191,831 | B2 | 3/2007 | Reid et al. | |
| 7,193,525 | B2 | 3/2007 | Miyamae et al. | |

(Continued)

FOREIGN PATENT DOCUMENTS

| | | |
|---|---|---|
| WO | 2009155268 A2 | 12/2009 |
| WO | 2011044427 A2 | 4/2011 |

*Primary Examiner* — Brad Harcourt

(74) *Attorney, Agent, or Firm* — Cathy Hewitt; Kenny Kincaid

(57) ABSTRACT

A downhole coring tool conveyable within a borehole extending into a subterranean formation, wherein the downhole coring tool comprises a housing, a hollow coring bit extendable from the housing, a first motor operable to rotate the coring bit, and a second motor operable to extend the coring bit into the subterranean formation through a sidewall of the borehole in a direction not substantially parallel to a longitudinal axis of the borehole proximate the downhole coring tool. A static sleeve disposed in but rotationally independent of the coring bit receives a portion of a core sample of the formation resulting from extension of the coring bit into the formation. The static sleeve comprises a protrusion extending radially inward toward the core sample sufficiently to mark the core sample.

20 Claims, 14 Drawing Sheets

(56) References Cited

U.S. PATENT DOCUMENTS

| | | | | |
|---|---|---|---|---|
| 7,259,689 | B2 | 8/2007 | Hernandez-Marti et al. | |
| 7,373,994 | B2 | 5/2008 | Tchakarov et al. | |
| 7,787,525 | B1 | 8/2010 | Clark, Jr. et al. | |
| 7,987,901 | B2 | 8/2011 | Krueger et al. | |
| 8,210,284 | B2 | 7/2012 | Buchanan et al. | |
| 2004/0065478 | A1* | 4/2004 | Gregory | 175/58 |
| 2009/0114447 | A1* | 5/2009 | Reid et al. | 175/58 |
| 2011/0174543 | A1 | 7/2011 | Walkingshaw et al. | |

* cited by examiner

DOWNHOLE CORING TOOLS AND METHODS OF CORING

CROSS-REFERENCE TO RELATED APPLICATION

This application claims the benefit of U.S. Provisional Patent Application No. 61/54,072 filed Sep. 29, 2011, the entire disclosure of which is hereby incorporated herein by reference.

BACKGROUND OF THE DISCLOSURE

Downhole coring tools are configured to operate in wells drilled into the ground or ocean bed, such as to recover oil and gas from hydrocarbon reservoirs in the Earth's crust. Once a drilled well reaches a formation of interest, geologists may investigate the formation and its contents through the use of downhole coring tools and/or other downhole tools. A core sample of the formation of interest, sometimes including hydrocarbon or other connate fluids trapped in the pores of the formation rock, may be acquired by the downhole coring tool. The core sample may then be transported to the Earth's surface, where it may be analyzed to assess the porosity of the formation rock, its mineral composition, the chemical composition of the fluids or other deposits contained in the pores of the rock, the rock permeability to various fluids, and/or the residual amount of hydrocarbon in the rock after flushing it with the various fluids, among other physical properties. The information obtained from analysis of the core sample may be used for making decisions about reservoir exploitation and/or other purposes.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
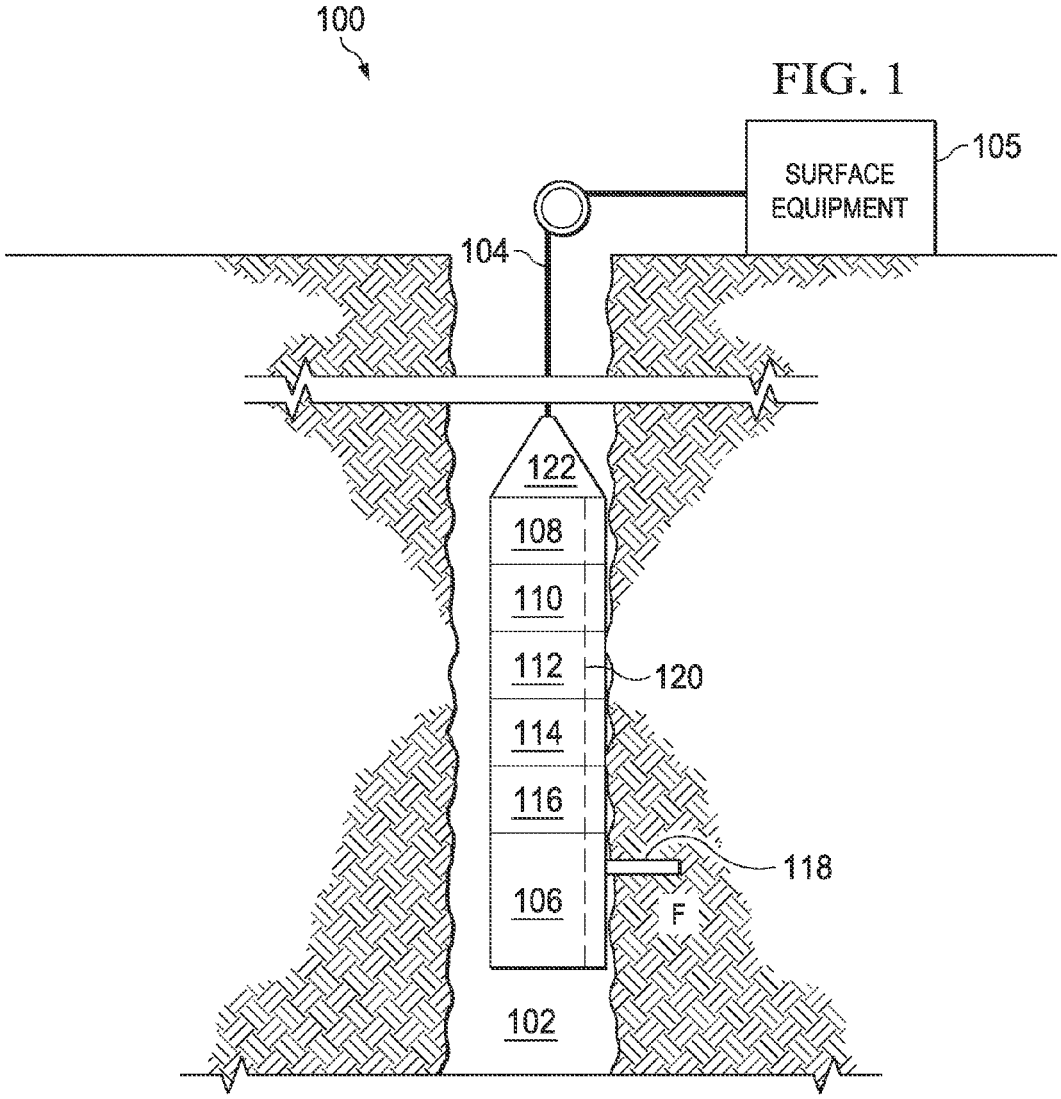
FIG. 1 is a schematic view of at least a portion of apparatus according to one or more aspects of the present disclosure.

Certain examples are shown in the above-identified figures and described in detail below. The figures are not necessarily to scale and certain features and certain views of the figures may be shown exaggerated in scale or in schematic for clarity and/or conciseness. It is to be understood that while the present disclosure provides many different embodiments or examples for implementing different features of various embodiments, other embodiments may be implemented and/or structural changes may be made without departing from the scope of the present disclosure. Further, while specific examples of components and arrangements are described below, these are merely examples and are not intended to be limiting. In addition, the present disclosure may repeat reference numerals and/or letters in the various examples. This repetition is for the purpose of clarity and does not in itself dictate a relationship between the various embodiments and/or example configurations discussed. Moreover, the depiction of a first feature over or on a second feature in the present disclosure may include embodiments in which the first and second elements are implemented in direct contact, and may also include embodiments in which other elements may be interposed between the first and second elements, such that the first and second elements need not be in direct contact.

FIG. 1 is a schematic view of at least a portion of a tool string 100 according to one or more aspects of the present disclosure. The tool string 100 is suspended in a borehole 102 at the end of a wireline cable 104. The wireline cable 104 is spooled on a winch (not shown) at the Earth's surface. The wireline cable 104 may provide electrical power to various components included in the tool string 100. The wireline cable 104 may additionally or alternatively provide a data communication link between various components in the tool string 100 and surface electronics and processing equipment 105.

The tool string 100 comprises a downhole coring tool 106. Although optional, the tool string 100 may also comprise one or more of an anchor and power sub 108, a telemetry tool 110, an inclinometry tool 112, a near borehole imaging tool 114 and/or a lithology analysis tool 116, among other possible tools, modules and/or components. The anchor and power sub 108 may be configured to controllably translate and/or rotate the remaining portion of the tool string 100 relative to the borehole 102. For example, the anchor and power sub 108 may be used to bring a coring bit 118 of the coring apparatus 106 into positional alignment with geological features of the formation F, which may have been detected, for example, by the near borehole imaging tool 114. The tools 106, 108, 110, 112, 114 and 116 may be connected via a tool bus 120 to a telemetry unit 122 which in turn may be connected to the wireline cable 104 for receiving and transmitting data and control signals between the tools and the surface equipment 105. The tool string 100 may be lowered to a particular depth of interest in the borehole 102 and then retrieved after downhole operations are performed. As the tools are retrieved from the borehole 102, the tools may collect and send data about the geological formation F via the wireline cable 104 to the surface equipment 105, which may be contained inside a logging truck or a logging unit (not shown).

Figure 2:
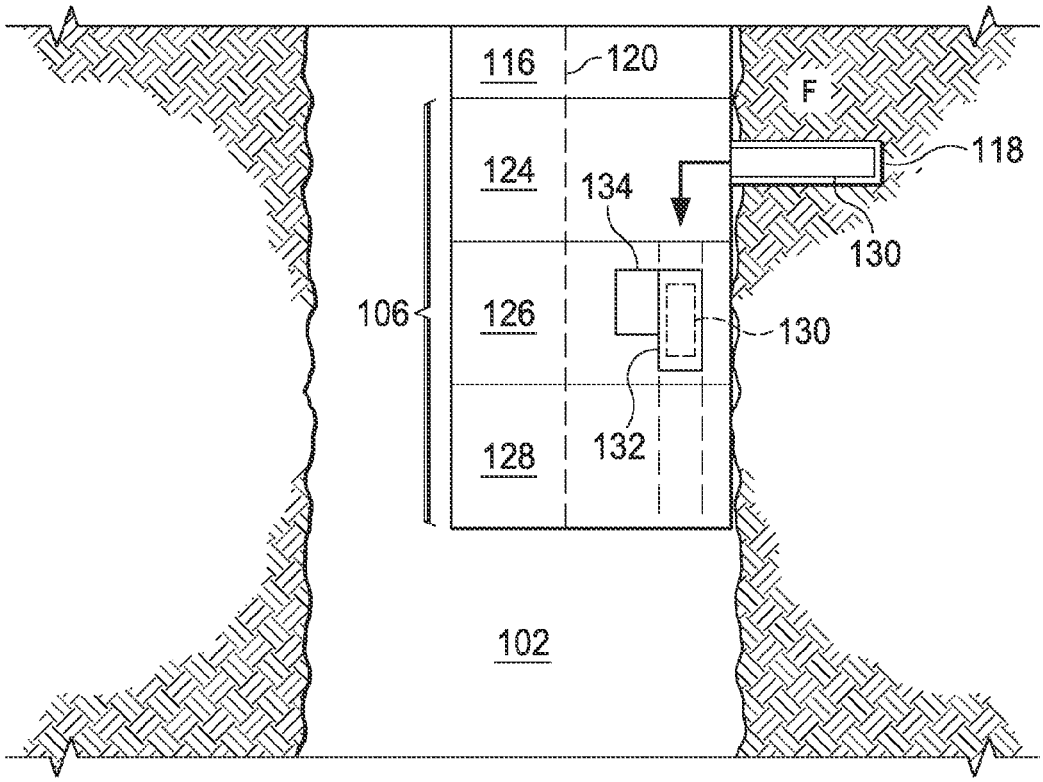
FIG. 2 is a schematic view of at least a portion of apparatus according to one or more aspects of the present disclosure.

As shown in the enlarged view of FIG. 2, the downhole coring tool 106 comprises at least one sidewall drill subassembly 124, and may further comprise at least one core analysis subassembly 126 and/or at least one core storage subassembly 128. The downhole coring tool 106 is operable to acquire multiple core samples during a single trip into the borehole 102. When the downhole coring tool 106 is lowered into a borehole 102 to a depth of interest, the sidewall drill subassembly 124 acquires a core sample 130 from the subterranean formation F. The sidewall drill subassembly 124 may enclose (entirely or partially) the acquired core sample 130 in a protective core holder 132 and then convey the protective core holder 132 containing the core sample 130 to the core analysis subassembly 126. The core analysis subassembly 126 may comprise a geophysical-property measuring unit 134 (or more than one geophysical-property measuring unit 134). The geophysical-property measuring unit 134 is connected via the tool bus 120 to the telemetry unit 122 for transmission of data to the surface equipment 105 via the wireline cable 104. The geophysical-property measuring unit 134 may be a gamma-ray detection unit that measures change in gamma-ray count rate as an object (e.g., a protective core holder 132 containing (or not containing) a core sample 130) crosses the measurement area of the gamma-ray detection unit 134. However, additional and/or alternative geophysical-property measuring units 134 other than for gamma-ray detection are also within the scope of the present disclosure.

After analysis of the core sample 130 is completed, the acquired core sample 130 may be conveyed from the core analysis subassembly 126 to the core storage subassembly 128. Multiple acquired core samples 130 may be stored in the core storage subassembly 128 for retrieval when the tool string 100 is retrieved from the borehole 102 the Earth's surface.

Figure 3:
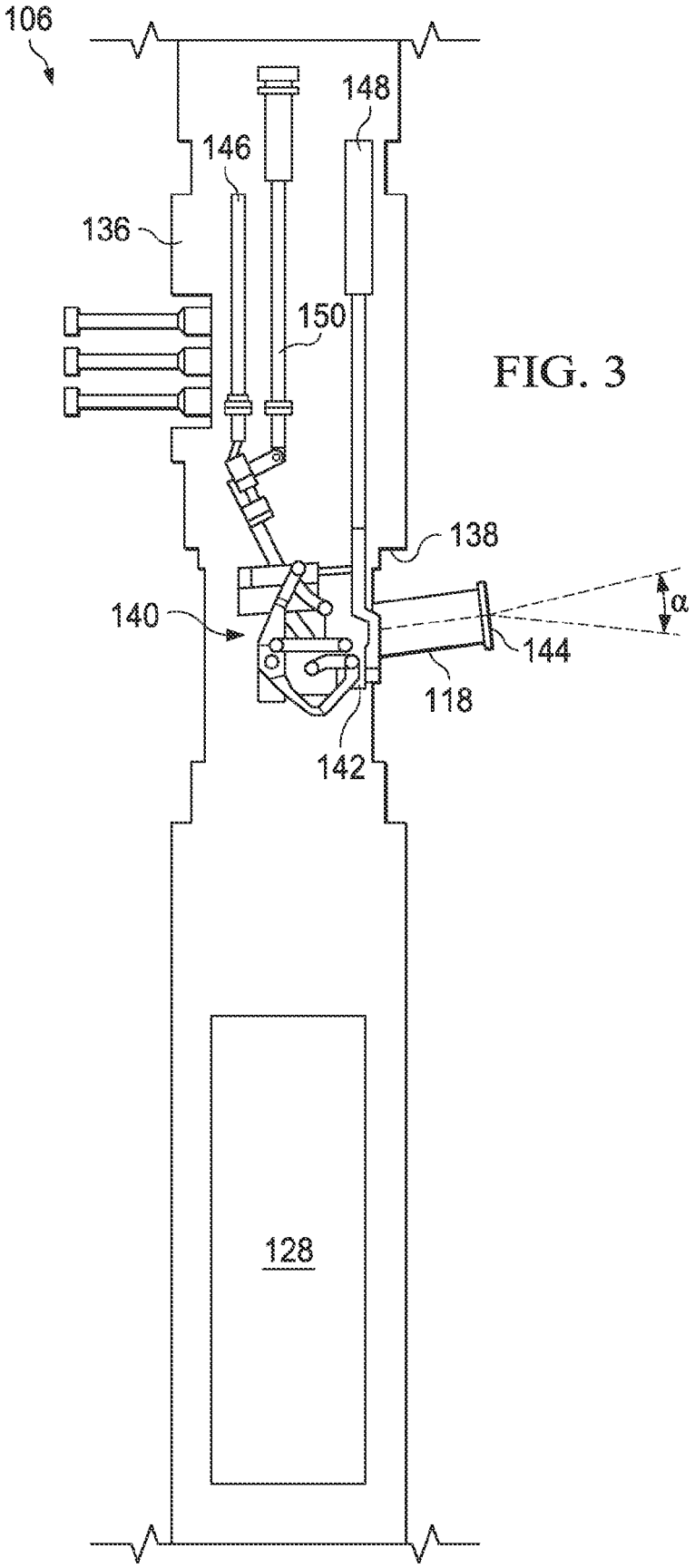
FIG. 3 is a schematic view of at least a portion of apparatus according to one or more aspects of the present disclosure.

FIG. 3 is another schematic view a portion of the downhole coring tool 106 shown in FIGS. 1 and 2. As shown in FIG. 3, the downhole coring tool 106 comprises a tool housing 136 configured for suspension within the borehole 102 at a selected depth, as described above. A coring aperture 138 is formed in the tool housing 136, and the core storage subassembly 128 is disposed in the tool housing 136. The downhole coring tool 106 comprises a coring apparatus 140 disposed within the tool housing 136. The coring apparatus 140 comprises a bit housing 142 pivotably coupled to the tool housing 136 in or between an eject position, in which the coring bit 118 registers with the core storage assembly 128 (see FIG. 4), and a coring position, in which the coring bit 118 registers with the coring aperture 138 (as shown in FIG. 3).

The coring bit 118 is mounted within the bit housing 142, and includes a cutting end 144. A hydraulic motor is hydraulically coupled to a pump (e.g., the hydraulic motor 176 and pump 602 shown in FIGS. 5 and 6 and described below) via flow lines 146. The hydraulic motor is operably coupled to, and configured to rotate, the coring bit 118. The downhole coring tool 106 may also comprise a series of pivotably connected extension link arms that have a first end pivotably coupled to the tool housing 136 and a second end to move the coring bit 118 between the retracted and extended positions. A first actuator 148 may be operably coupled to the coring bit 118 and configured to actuate the coring bit 118 from a retracted position to an extended position. A second actuator 150 may be operably coupled to the bit housing 142 and configured to rotate the bit housing 142 between the eject and coring positions. Extension of the coring bit 118 may thus be decoupled from the rotation of the bit housing 142. Consequently, and notwithstanding any clearance issues with the tool housing 136 or other tool structures, the coring bit 118 may be extended at any time regardless of the position of the bit housing 142.

Figure 4:
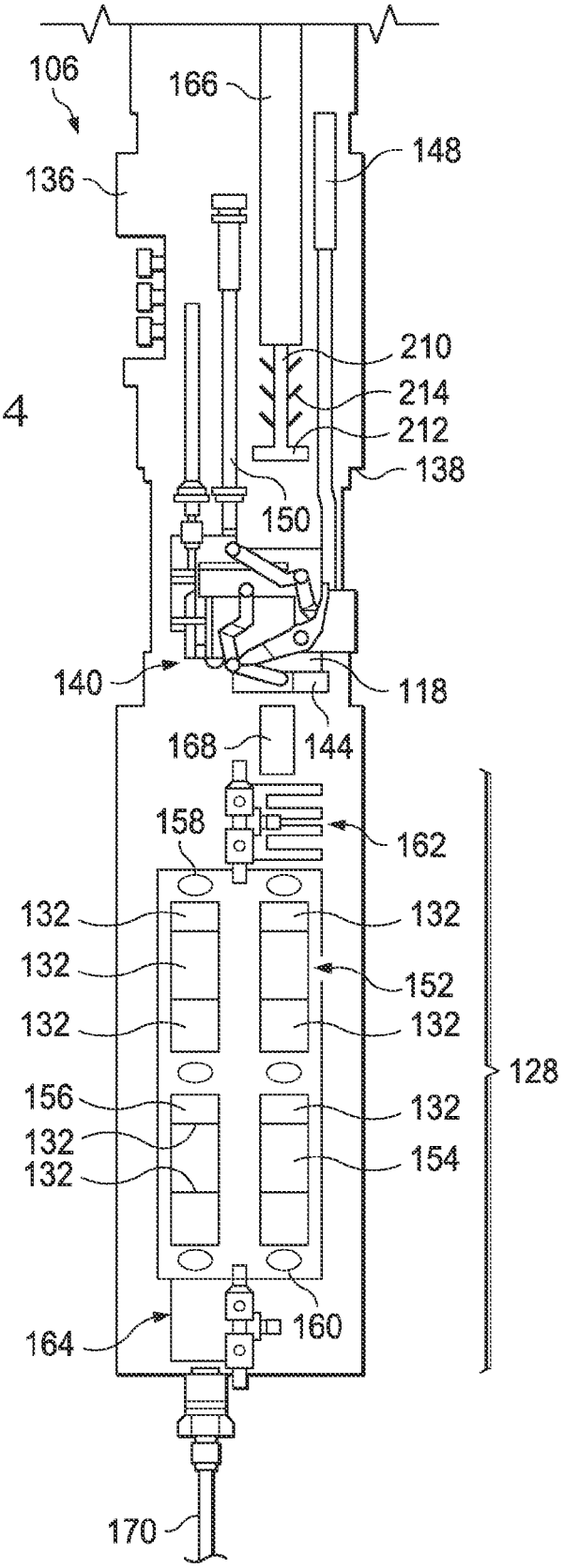
FIG. 4 is a schematic view of at least a portion of apparatus according to one or more aspects of the present disclosure.

As shown in FIG. 4, the core storage subassembly 128 comprises a core receptacle 152. The core receptacle 152 comprises a first storage column 154, a second storage column 156, a proximal end 158 positioned nearer to the coring apparatus 140, and a distal end 160 positioned further from the coring apparatus 140. A proximal shifter 162 is disposed adjacent the core receptacle proximal end 158, and is rotatable or otherwise movable between a first position, in which the proximal shifter 162 registers with a proximal end of the first storage column 154, and a second position, in which the proximal shifter 162 registers with a proximal end of the second storage column 156. A distal shifter 164 is disposed adjacent the core receptacle distal end 160, and is similarly rotatable or otherwise movable between a first position, in which the distal shifter 164 registers with a distal end of the first storage column 154, and second position, in which it registers with a distal end of the second storage column 156. A first transporter 166, positioned coaxial with the first storage column 154, is adapted to transport a core sample from the coring apparatus 140 to the proximal shifter 162 through a core transfer tube 168 and to the first storage column 154. The first transporter 166 may comprise a handling piston 210 having a shoe 212 that pushes the core sample out of the coring apparatus 140. One or more brush members 214 may also extend radially outward from the handling piston 210, such as may be utilized to remove debris from the coring apparatus 140 as the first transporter 166 pushes out the core sample. The core transfer tube 168 may be substantially similar or identical to the protective core holder 132 shown in FIG. 2, or may be a fixed "tunnel" to guide the core sample being pushed by the first transporter 166. A second transporter 170, positioned coaxial with the second storage column 156, advances a protective core holder 132 from the distal shifter 164 to the second storage column 156. In operation, the core storage subassembly 128 may be used to transfer protective core holders 132 between the coring apparatus 140 and the core storage subassembly 128, and/or to store protective core holders 132 in one or more adjacent storage columns 154/156.

Figure 5:
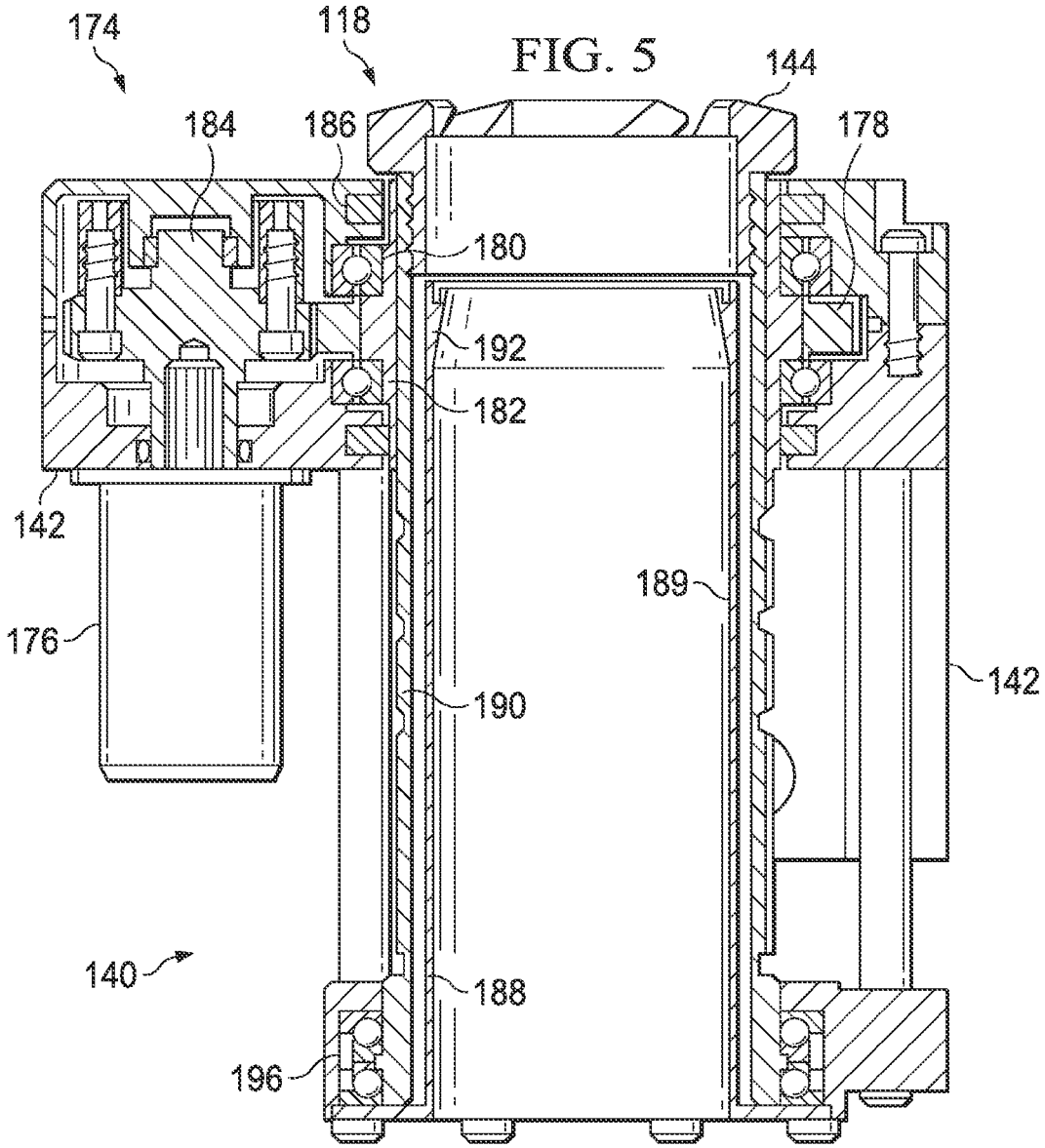
FIG. 5 is a schematic view of at least a portion of apparatus according to one or more aspects of the present disclosure.

FIG. 5 is a schematic view of the coring apparatus 140 described above. The coring apparatus 140 includes the bit housing 142, which is selectively pivotable in the downhole coring tool 106. The coring apparatus 140 also comprises the rotatable coring bit 118 having the cutting end 144, a gearbox 174, and a motor 176 affixed to the bit housing 142 and operatively coupled to the gearbox 174. The gearbox 174 comprises a gear drive 178 rotatively coupled to the bit housing 142. For example, the gear drive 178 may be rotationally coupled to the bit housing 142 via ball bearings, one of which is designated as reference numeral 180. The gearbox 174 further comprises a key member 182 that engages an inner surface of the gear drive 178 and an outer surface of the coring bit 118 to maintain a rotational relationship between the coring bit 118 and the gear drive 178. The gearbox 174 further comprises a pinion 184, rotatively coupled to the bit housing 142, which engages an outer surface of the gear drive 178 and the motor 176. The coring apparatus 140 may also comprise thrust bearings 196 configured to permit rotation of the coring bit 118 in the bit housing 142. One or more seals 186 may prevent fluid from seeping or infiltrating into the gearbox 174. The gear drive 178, key member 182, pinion 184, and motor 176 collectively pivot in unison with the bit housing 142. A static sleeve 188 is provided inside a hollow shaft 190 of the coring bit 118, and is affixed to the bit housing 142. The coring shaft 190 is rotated via the gearbox 174 by the motor 176 as the gearbox 174 engages the key member 182.

The static sleeve 188 may comprise one or more protrusions 192 extending radially inward from an inner circumference 189 of the static sleeve. The protrusions 192 may be configured to create a groove, scratch or other mark on a core sample, such as to indicate an original orientation of the core sample in the formation relative to the borehole. As shown in FIG. 5, the protrusions 192 may be disposed at the distal end of the static sleeve 188, proximate the cutting end 144 of the coring bit 118. The protrusions 192 may be configured to mark the sidewall end of extracted core samples at the conclusion of the core cutting operation, when the coring bit 118 is significantly extended into the formation. The mark is indicative of the orientation of the core samples in the formation. As described above with reference to FIG. 4, the core samples present in the coring apparatus 140 are ejected from the coring apparatus 140 by extending the first transporter 166 through the coring apparatus 140 to push the core sample in a downward direction and into the core storage subassembly 128. Because of the position of the protrusions 192 and the direction of ejection of the core sample, the mark is not extended along the length of the core sample as the core sample is ejected from the coring apparatus 140. That is, the protrusions 192 shown in FIG. 5 permit marking core samples on only a relatively small portion of their length (e.g., less than about 50 percent), and preserve intact a relatively large portion of their length (e.g., more than about 50 percent). Marks that preserve intact a relatively large portion of the core sample length may not jeopardize subsequent analysis of the core sample.

Figure 6:
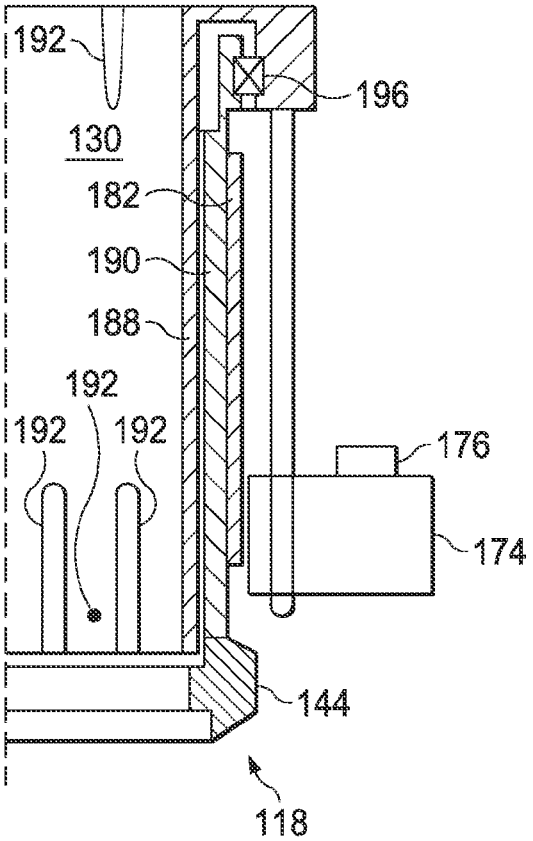
FIG. 6 is a schematic view of at least a portion of apparatus according to one or more aspects of the present disclosure.
Figure 7:
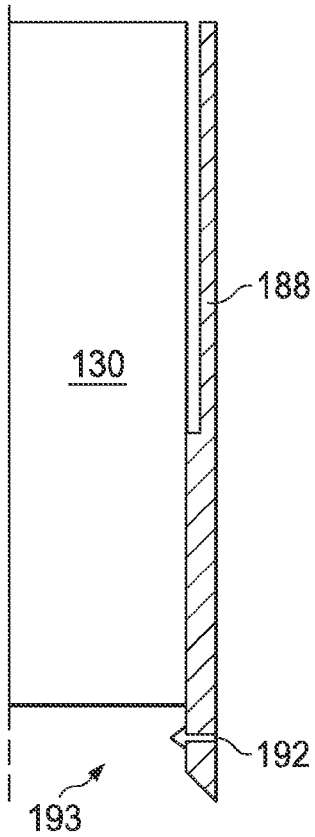
FIG. 7 is a schematic view of at least a portion of apparatus according to one or more aspects of the present disclosure.

The protrusions 192 may each have different shapes and may be provided in quantities other than as shown in the figures. The protrusions 192 may alternatively or additionally be provided in different locations relative to the static sleeve 188. For example, FIG. 6 schematically depicts a portion of the coring apparatus 140 wherein one or more protrusions 192 may also be provided at the opposite end of the static sleeve 188. In the example, of FIG. 6, the additional protrusions 192 near the cutting end 144 of the coring bit 118 include both elongated protrusions and circular protrusions, although others are also within the scope of the present disclosure. Similarly, FIG. 7 schematically depicts a portion of the coring apparatus 140 wherein a protrusion 192 is shaped at least somewhat akin to a rivet, screw, brad or other mechanical member having a sharp end 193 protruding radially inward for marking the core sample. For example, the protrusion 192 shown in FIG. 7 may merely comprise a rivet, screw, brad or other mechanical member extending through the wall of the static sleeve 188, and may be coupled to the wall of the static sleeve 188 via bonding, welding, press-fit, interference-fit, adhesive, threads, swaging and/or other means. Any protrusion 192 within the scope of the present disclosure may be formed integral to the static sleeve 188 or may be a discrete component coupled to the static sleeve 188. Similarly, any one or more of the protrusions 192 shown herein may be implemented for a particular embodiment, whether in combination or independently.

Figure 8A:
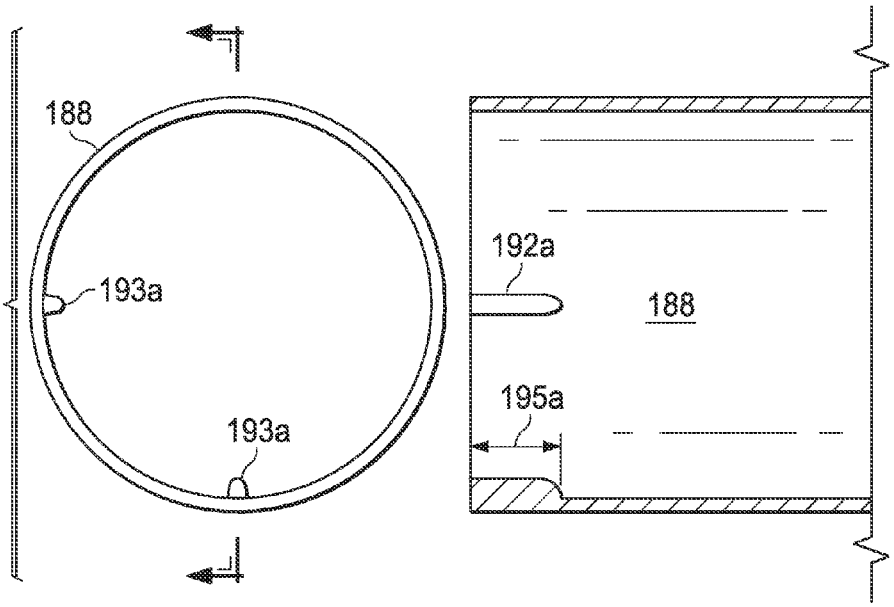
FIGS. 8A-8F is a schematic view of at least a portion of apparatus according to one or more aspects of the present disclosure.
Figure 8B:
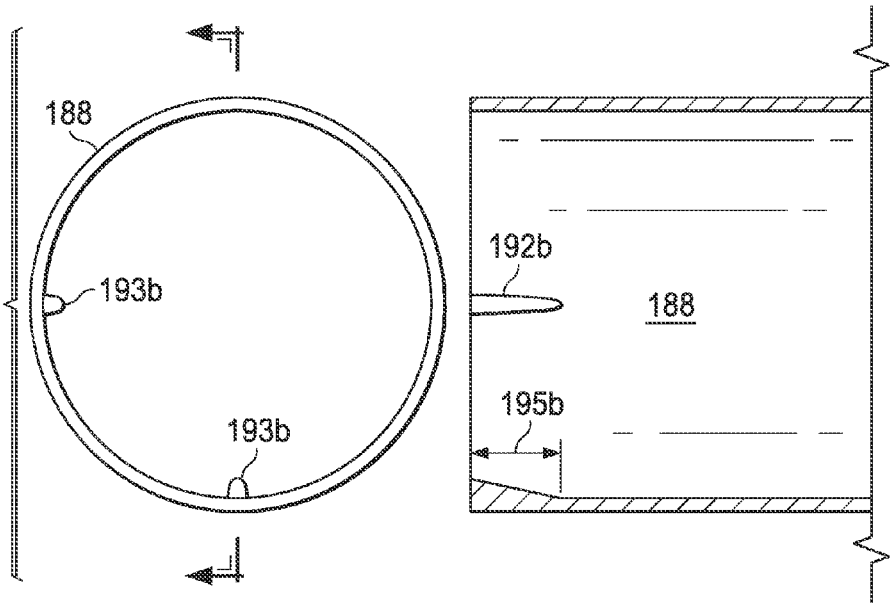

The shape of the protrusions 192 may also vary within the scope of the present disclosure. FIGS. 8A-F depict several example shapes of the protrusions. In FIG. 8A, the protrusion 192*a* has a ridge shape having a rounded cross-sectional profile 193*a* extending a length 195*a* in the axial direction of the static sleeve 188. The stylus-shaped protrusion 192*b* shown in FIG. 8B has a similar rounded profile 193*b* extending a length 195*b* in the axial direction of the static sleeve 188, but whereas the thickness of the protrusion 192*a* of FIG. 8A is uniform along a substantial portion of the length 195*a*, the thickness of the stylus-shaped protrusion 192*b* of FIG. 8B decreases along the length 195*b*.

Figure 8C:
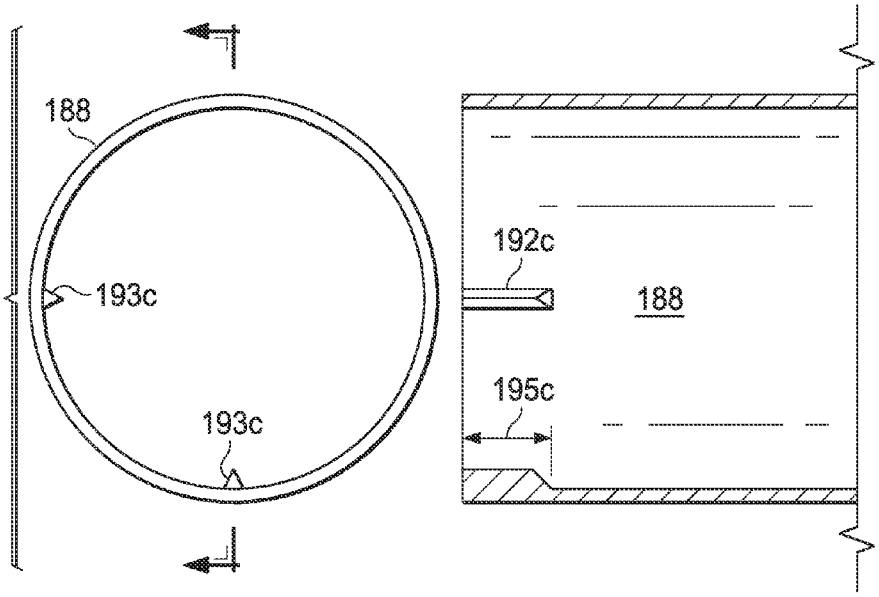
Figure 8D:
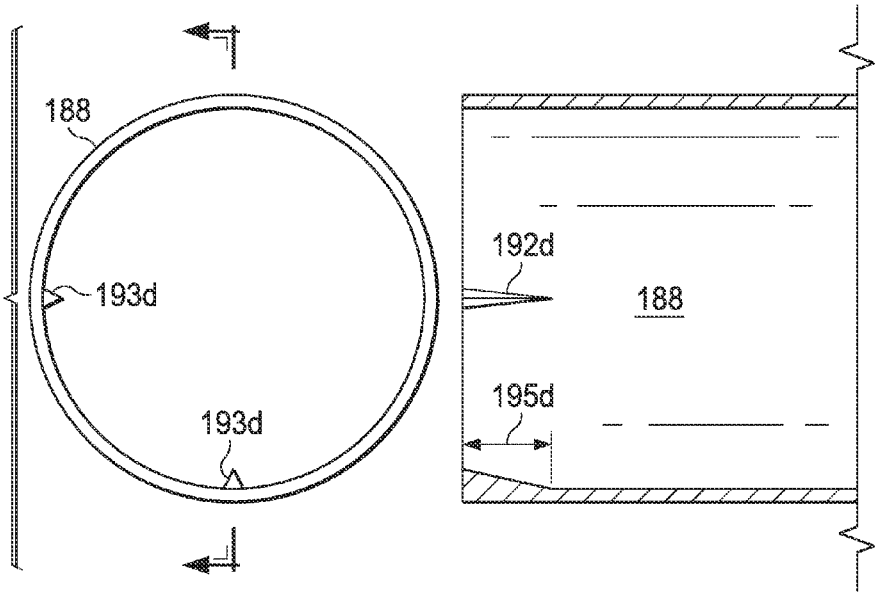

In FIG. 8C, the protrusion 192*c* has a first knife shape having a pointed cross-sectional profile 193*c* extending a length 195*c* in the axial direction of the static sleeve 188. The protrusion 192*c* also has a tetrahedron shape, and tetrahedron shapes other than as shown in FIG. 8C are also within the scope of the present disclosure. The protrusion 192*d* shown in FIG. 8D has a second knife shape having a similar pointed profile 193*d* extending a length 195*d* in the axial direction of the static sleeve 188, but whereas the thickness of the protrusion 192*c* of FIG. 8C is uniform along a substantial portion of the length 195*c*, the thickness of the protrusion 192*d* of FIG. 8D decreases along the length 195*d*.

Figure 8E:
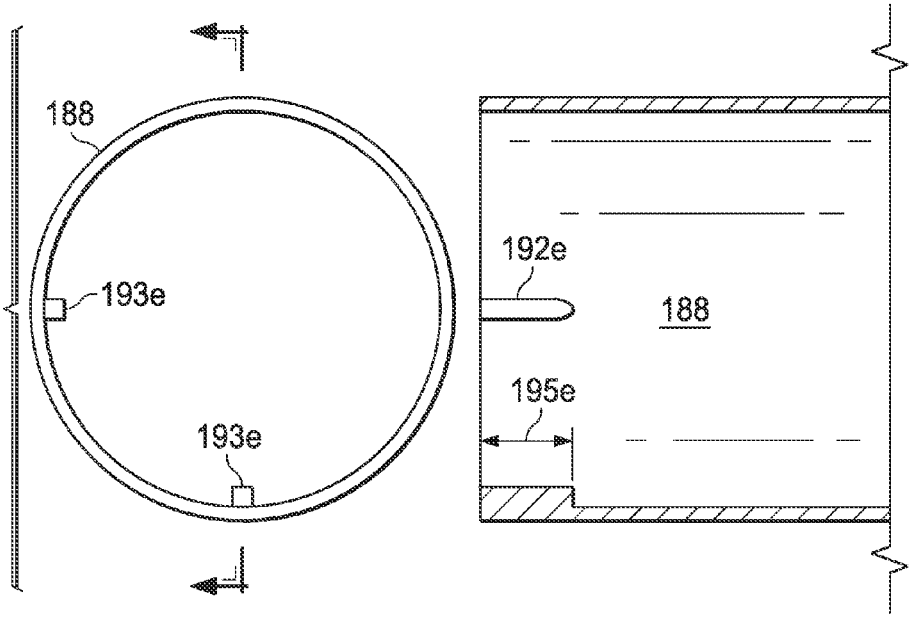
Figure 8F:
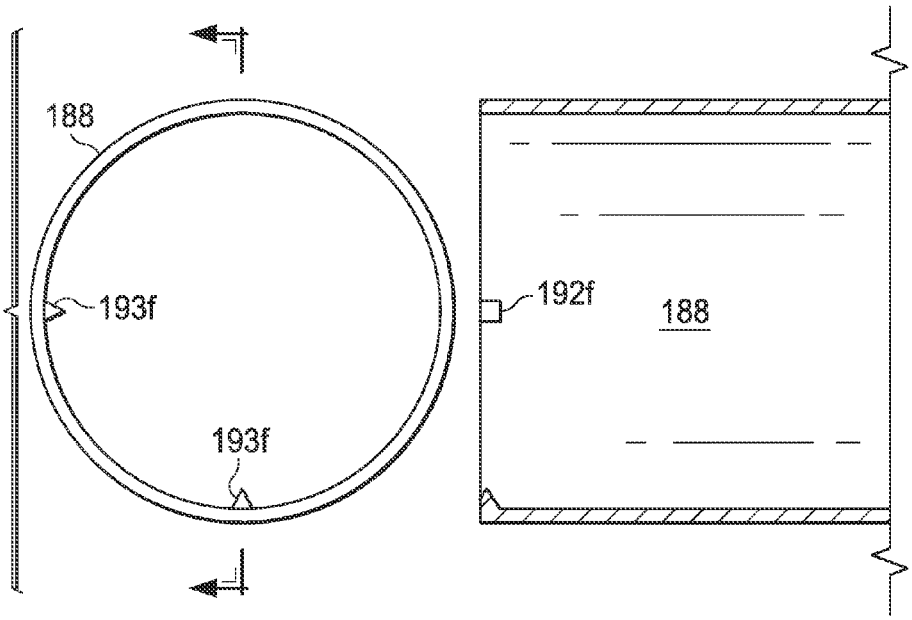

In FIG. 8E, the finger-shaped protrusion 192*e* has a square- or rectangular-shaped cross-sectional profile 193*e* extending a length 195*e* in the axial direction of the static sleeve 188. The end of the finger-shaped protrusion 192 may be square or, as shown in FIG. 8E, may be rounded. The protrusion 192*f* shown in FIG. 8F has a pyramid shape with a square base. However, other pyramid-shaped protrusions are also within the scope of the present disclosure, including those with base shapes other than the square base shown in FIG. 8F, such as rectangular, pentagonal and star-shaped based, among others. Cone-shaped and cylindrical protrusions are also within the scope of the present disclosure.

Figure 9:
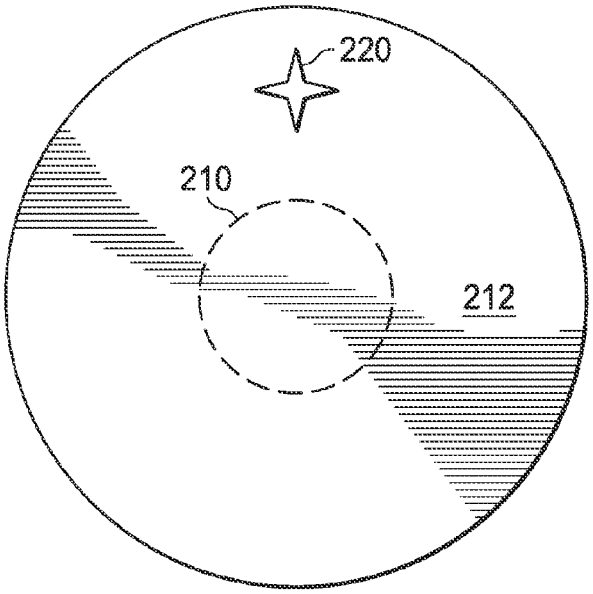
FIG. 9 is a schematic view of at least a portion of apparatus according to one or more aspects of the present disclosure.

Other portions of the coring apparatus 140 may also or alternatively be employed to mark the core sample 130. For example, as shown in FIG. 9, the shoe 212 (e.g., a brass front plate) of the handling piston 210 may include a sharp tip 220 configured to indent a mark on the sidewall end of the core sample while the core sample is being pushed out of the coring apparatus 140. The tip 220 may be offset from the center of the shoe 212. A locking device (e.g., a key) may be provided to ensure that the handling piston 210 remains in a certain orientation with respect to the coring apparatus 140 so that the rotational location of the tip 220 relative to the coring apparatus 140 will be known. The sharp point 220 may have the shape of a ridge, a knife, a finger, a stylus, a tetrahedron, or a pyramid, among others. Note that the pyramid may have a square, pentagonal or star-shaped base, among others.

Figure 10:
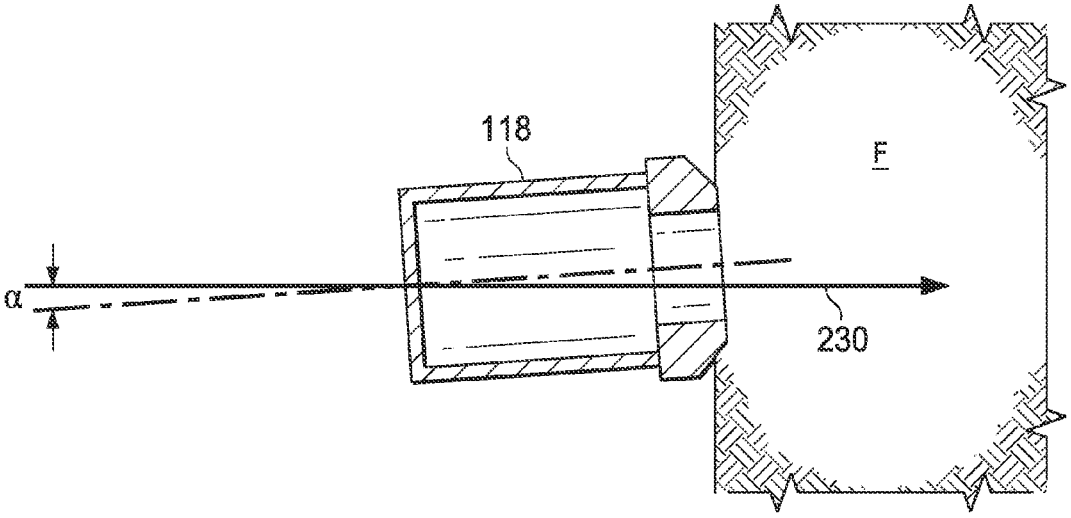
FIG. 10 is a schematic view of at least a portion of apparatus according to one or more aspects of the present disclosure.
Figure 11:
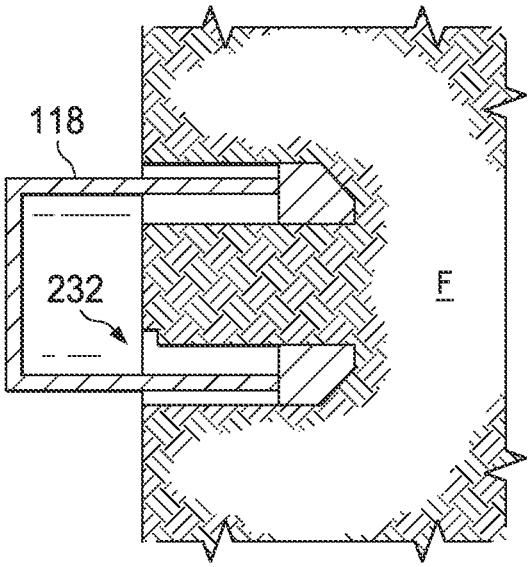
FIG. 11 is a schematic view of at least a portion of apparatus according to one or more aspects of the present disclosure.

FIGS. 10 and 11 illustrate at least a portion of a method of indicating the original orientation of core samples according to one or more aspects of the present disclosure. The method comprises extending the coring bit 118 into the formation F at a first angle $\alpha$ relative to the coring direction 230 (indicated in FIG. 10 by arrow 230) to form a mark 232 with the coring bit 118, retracting the coring bit 118, extending the coring bit 118 into the formation F in the coring direction 230 (or at a second angle different from the first angle $\alpha$), and retrieving the core sample 130 from the formation. Extending the coring bit 118 into the formation F at the first angle $\alpha$ may be performed while rotating or without rotating the coring bit 118. For example, an operator having prior knowledge that the formation is unconsolidated (e.g., having an unconfined compressive strength lower than about 5000 psi) may command the downhole coring tool 106 to extend the coring bit 118 without rotating it, and otherwise while rotating it. Alternatively, the operator may command the downhole coring tool 106 to extend the coring bit 118 without rotating it, then monitor a rate of extension of the coring bit 118 and a force resisting the extension of the coring bit 118, and then command the downhole coring tool 106 to rotate the coring bit 118 based on the monitored extension rate and resisting force. If the extension rate and resisting force are indicative of an unconsolidated formation, the operator may choose to continue extending the coring bit 118 without rotating it. Conversely, the operator may choose to command the downhole coring tool 106 to extend the coring bit 118 while rotating it, then monitor the rate of extension of the coring bit 118 and the force resisting the extension of the coring bit 118, and then command the downhole coring tool 106 to stop rotating the coring bit 118 based on the monitored extension rate and resisting force. If the extension rate and resisting force are indicative of an unconsolidated formation, the operator may choose to command the downhole coring tool 106 to stop rotating the coring bit 118, and otherwise let the downhole coring tool 106 continue extending the coring bit 118 while rotating it.

Figure 12:
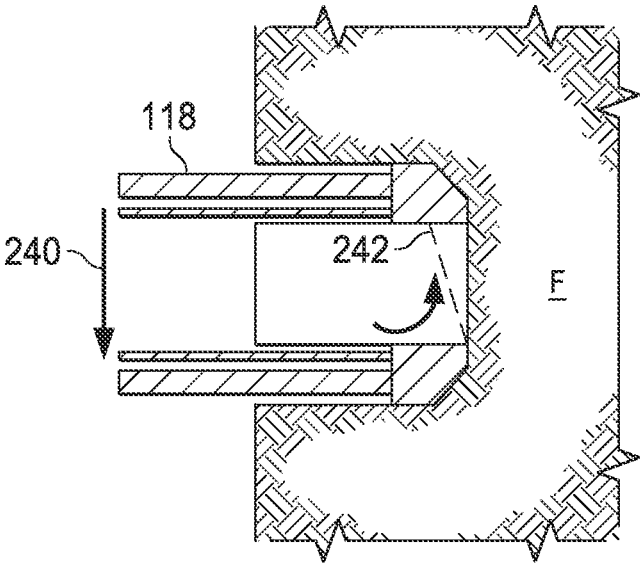
FIG. 12 is a schematic view of at least a portion of apparatus according to one or more aspects of the present disclosure.

Another method of indicating the original orientation of core samples according to one or more aspects of the present disclosure involves using a pitch of a plane of the fracture generated in the formation rock when a core sample is severed from the formation. In this method, a downhole coring tool operator records the direction of loading utilized to sever the core sample. A computation of the pitch of a plane of the fracture (e.g., the direction of the steepest slope on the fracture plane) as a function of the direction of loading is performed using a fracture mechanics prediction tool (e.g., commercially available finite element software). Once at surface, the operator observes the fracture plane of core samples to determine their pitch, and determines the original orientation of the core samples in the formation from the observed fracture plane and the computed pitch. As shown in FIG. 12, for example, a severing load (indicated in FIG. 12 by arrow 240) applied to a proximal end of the coring bit 118 in a generally downward direction (relative to the borehole) may induce a counterclockwise rotation of the coring bit 118 and give rise to a fracture plane 242. Note that this method may be more useful in consolidated formations (e.g., formations having an unconfined compressive strength higher than about 5000 psi).

Figure 13:
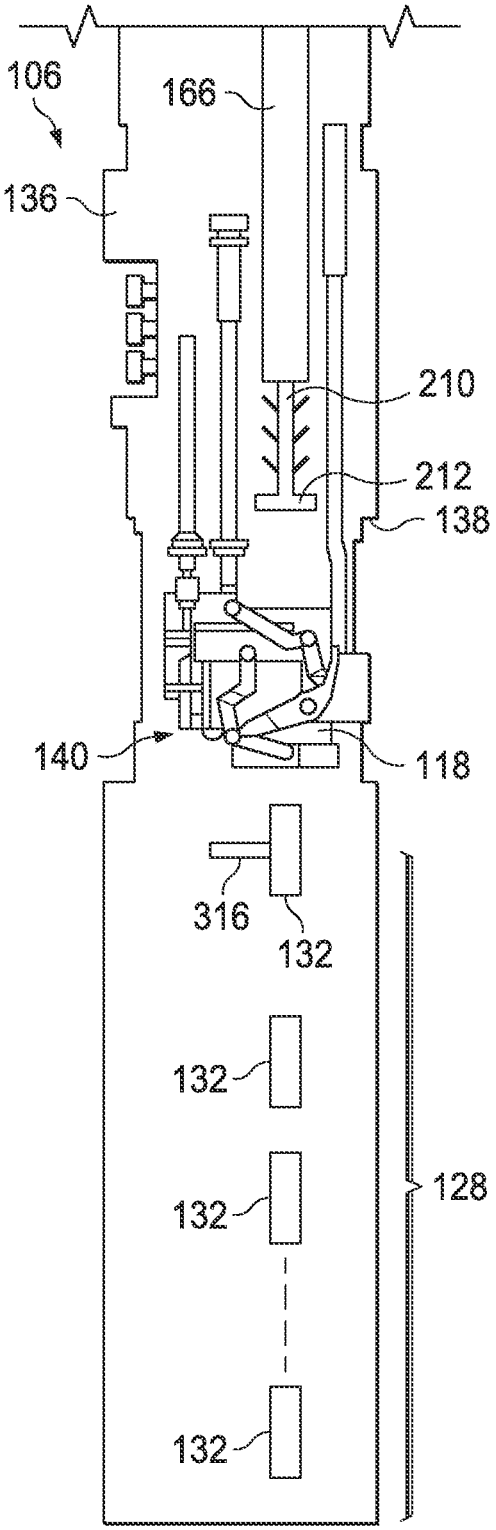
FIG. 13 is a schematic view of at least a portion of apparatus according to one or more aspects of the present disclosure.
Figure 14:
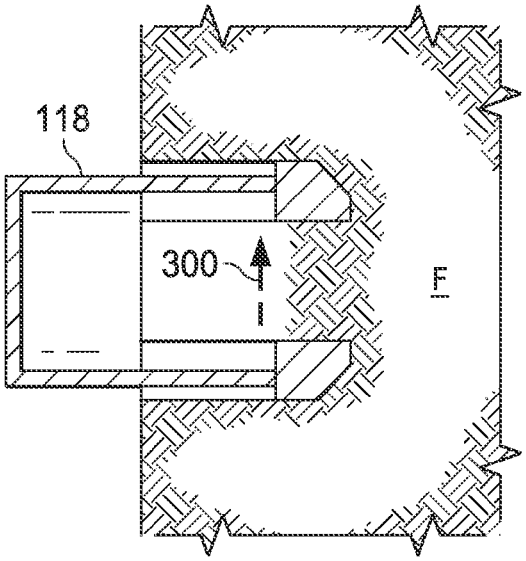
FIG. 14 is a schematic view of at least a portion of apparatus according to one or more aspects of the present disclosure.
Figure 15:
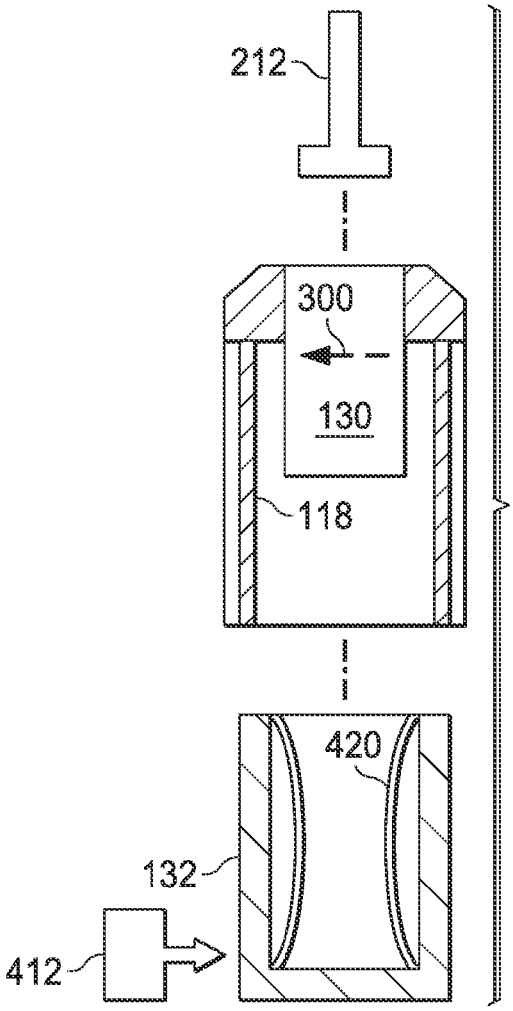
FIG. 15 is a schematic view of at least a portion of apparatus according to one or more aspects of the present disclosure.
Figure 16:
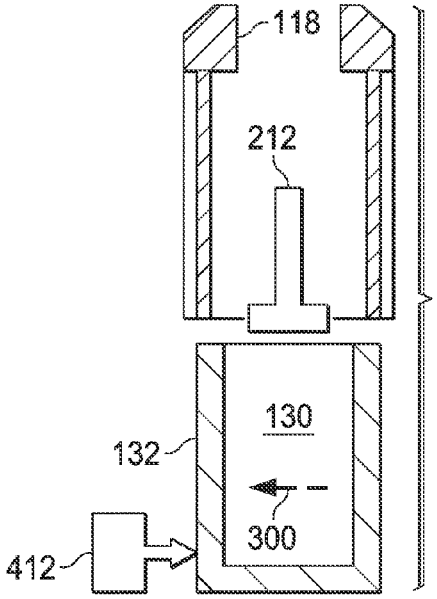
FIG. 16 is a schematic view of at least a portion of apparatus according to one or more aspects of the present disclosure.

FIGS. 13-16 illustrate an additional or alternative method of indicating the original orientation of core samples in the formation according to one or more aspects of the present disclosure. The method may be performed by the downhole coring tool 106 and/or other apparatus shown in the figures, described herein or otherwise within the scope of the present disclosure. Referring to FIGS. 13 and 14, the coring apparatus 140 is rotated and translated through the coring aperture 138 to engage the coring bit 118 with the formation F at the location from which a core sample 130 is to be extracted. The original orientation of the core sample 130 relative to the borehole (or to the downhole coring tool 106) is indicated in FIGS. 14-16 by arrow 300.

Referring to FIGS. 13 and 15, once the coring bit 118 has extracted the core sample 130, the coring apparatus 140 rotates back into the position shown in FIG. 13. Note that this operation may modify the original orientation of the core sample 130 relative to the borehole in a reproducible way. The first transporter 166 is extended so that the handling piston foot 212 moves or pushes the core sample 130 out of the coring apparatus 140 and into the protective core holder 132, which may be held in the column 154 of the core storage subassembly 128. Again, note that this operation may modify the original orientation of the core sample 130 relative to the borehole in a reproducible way. The protective core holder 132 may be provided with bow springs and/or other means 420 to prevent relative rotation between the core sample 130 and the protective core holder 132.

Referring to FIGS. 13 and 16, once the core sample 130 has been deposited in the protective core holder 132, a force applied by a core holder retainer 316 to the protective core holder 132 therein may be reduced to continue to frictionally engage and hold the protective core holder 132, but allow movement of the protective core holder 132 relative to the core holder retainer 316 in response to force applied by the first transporter 306. This reduced force may be selected so that a scriber 412 operatively coupled to the core holder retainer 316 is maintained in contact with a surface (e.g., an outer surface) of the protective core holder 132 within the column 154 of the core storage subassembly 128. The transporter 166 may be controlled to move the protective core holder 132 away from the core holder retainer 316 while the reduced amount of force is being applied to the protective core holder 132, thereby forming a mark (e.g., a vertical score line or scratch) having a known controlled position on the surface of the protective core holder 132 relative to the arrow 300 indicative of the original orientation of the core sample 130 relative to the borehole. Thus, once the desired mark has been formed on the surface of the protective core holder 132, the original orientation of the core sample 130 relative to the borehole can be determined at the surface, regardless of rotations of the protective core holder 132 occurring during the transportation to the surface or elsewhere.

Geologists have interest in knowing the position that core samples occupied in the formation of interest at the time they were taken from the formation. The core sample position may include data indicative of the depth of the coring bit at the time the downhole coring tool was set against the borehole sidewall. Such data may be acquired using, for example, the length of the wireline cable deployed in the borehole, corrected for effects such as the cable tension/extension. The core sample position may also include data indicative of the orientation of the downhole coring tool relative to the Earth's magnetic field and/or the inclination of the downhole coring tool relative to the Earth's gravity field. Orientation and inclination data may also be obtained, for example, from magnetometers, accelerometers, and/or gyroscopes coupled to a housing of the downhole coring tool. Other data indicative of core sample position may include the original orientation of the core sample relative to the axis of the borehole. Geologists may use such data to determine or confirm the dip and/or strike of formation beds, for example. Thus, a downhole coring tool according to one or more aspects of the present disclosure may comprise one or more devices capable of indicating or aiding the indication of the original orientation of core samples obtained from a formation relative to the axis of the borehole. These devices may be configured to indicate the original direction of the longitudinal axis of the downhole coring tool with a mark on the core sample and/or core holder in which the core sample is stored. Note that the original orientation of the core sample relative to the axis of the borehole and the original orientation of the core sample relative to the longitudinal axis of the downhole coring tool are strictly identical only when the downhole coring tool is aligned with the borehole, but essentially similar in practice. Thus, the core samples and/or the core holders may thereafter be rotated while the mark still indicates the original direction of the axis of the borehole.

Figure 17:
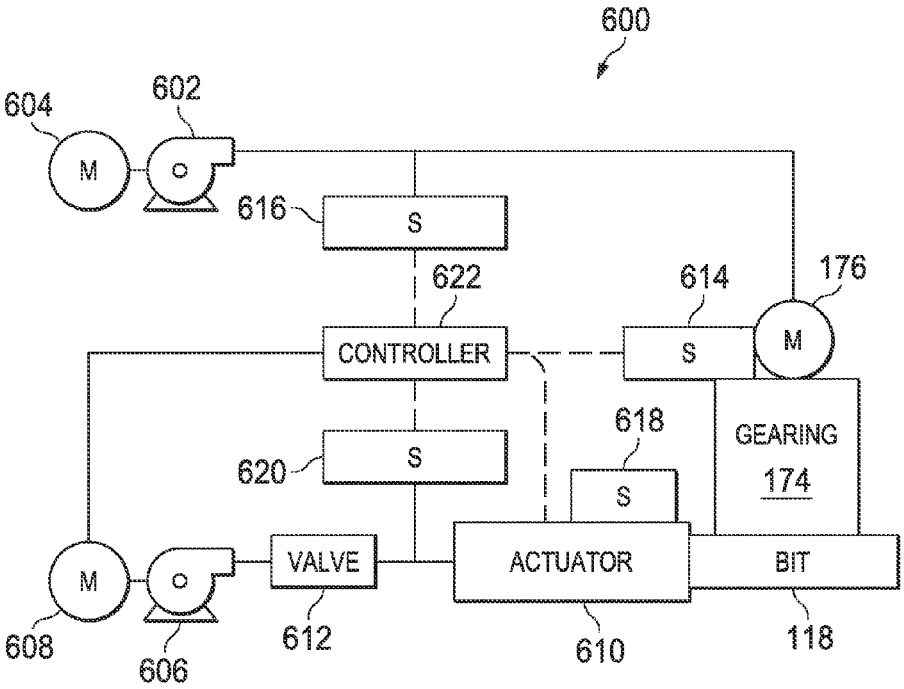
FIG. 17 is a schematic view of at least a portion of apparatus according to one or more aspects of the present disclosure.

FIG. 17 is a schematic view of an actuation system 600 for at least partially automated coring according to one or more aspects of the present disclosure. The actuation system 600 may be implemented with one or more of the apparatus shown in FIGS. 1-16. The actuation system 600 comprises a first hydraulic pump 602 driven by a first motor 604, the hydraulic bit motor 176 driven by the first hydraulic pump 602, the coring bit 118 rotationally driven by the hydraulic bit motor 176, and a second hydraulic pump 606 driven by a second motor 608. The actuation system 600 also comprises an actuator 610 linearly driven by hydraulic fluid received from the second hydraulic pump 606 (perhaps via a pressure-damping valve 612) and configured to extend the coring bit 118.

Sensors 614, 616, 618 and 620 are configured to sense various coring operation parameters. For example, the sensors may indicate whether coring is occurring in consolidated or unconsolidated formations (e.g., formations having an unconfined compressive strength respectively higher or lower than about 5000 psi). A controller 622 may direct an automated coring operation by driving the speed of first and second motors 604 and 608, and/or the pressure-damping valve 612, based on the coring operation parameters.

To facilitate conveyance in the borehole well, downhole tool strings within the scope of the present disclosure may be provided with rollers, standoffs, bogies and/or other means to reduce the drag between the tool string and the sidewall of the borehole. Also, the downhole tool string may be provided with knuckle joints to accommodate well trajectories having high curvature or high dogleg. To mitigate sticking against the sidewall of the borehole, the downhole tool string may be provided with anchoring or centralizing pistons, some of which having a ball or a wheel at the end thereof.

In view of all of the above, the following claims and the figures, those skilled in the art should readily recognize that the present disclosure introduces an apparatus comprising a downhole coring tool conveyable within a borehole extending into a subterranean formation, wherein the downhole coring tool comprises: a housing; a hollow coring bit extendable from the housing; a first motor operable to rotate the coring bit; a second motor operable to extend the coring bit into the subterranean formation through a sidewall of the borehole in a direction not substantially parallel to a longitudinal axis of the borehole proximate the downhole coring tool; and a static sleeve disposed in but rotationally independent of the coring bit, wherein the static sleeve receives a portion of a core sample of the formation resulting from extension of the coring bit into the formation, and wherein the static sleeve comprises a protrusion extending radially inward toward the core sample sufficiently to mark the core sample. The housing may be selectively pivotable within the downhole coring tool. The first and second motors may be independently operable such that rotation of the coring bit is independent of extension of the coring bit. The static sleeve may be positionally fixed relative to the housing. The downhole coring tool may further comprise gearing engaging an outer surface of the coring bit and driven by the first motor. The gearing may engage a key member on the outer surface of the coring bit.

The downhole coring tool may further comprise: a pinion driven by the first motor; and a gear drive driven by the pinion and engaging the coring bit thereby imparting rotation to the coring bit. An external surface of the gear drive may engage the pinion, and an internal surface of the gear drive may engage the coring bit. The coring bit may comprise an exterior key member, and the internal surface of the gear drive may engage the key member. The gear drive, key member, pinion and first motor may be coupled to the housing to collectively pivot in unison with the housing.

The downhole coring tool may further comprise a transporter comprising: a shoe; and a handling piston to extend the shoe through the static sleeve, thereby pushing the core sample out of the sleeve such that the protrusion simultaneously marks the core sample.

The protrusion may be integral to the static sleeve. The protrusion may alternatively comprise a mechanical member extending through a wall of the static sleeve.

The static sleeve may have a first end proximate a cutting end of the coring bit and a second end distal from the cutting end of the coring bit, and the protrusion may be located proximate the first end of the static sleeve.

The static sleeve may have a first end proximate a cutting end of the coring bit and a second end distal from the cutting end of the coring bit, and the protrusion may be located proximate the second end of the static sleeve.

The protrusion may have a ridge shape, a knife shape, a finger shape, a stylus shape, a tetrahedron shape or a pyramid shape, among others. When pyramid-shaped, the protrusion may have a base having a square shape, a pentagon shape or a star shape, among others.

The protrusion may be one of a plurality of protrusions each extending radially inward into contact with the core sample sufficiently to mark the core sample. One of the plurality of protrusions may be differently shaped. The static sleeve may have a first end proximate a cutting end of the coring bit and a second end distal from the cutting end of the coring bit, wherein at least one of the plurality of protrusions may be located proximate the first end of the static sleeve, and wherein at least one of the plurality of protrusions may be located proximate the second end of the static sleeve.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a downhole coring tool conveyable within a borehole extending into a subterranean formation, wherein the downhole coring tool comprises:

a housing;

a coring bit extendable from the housing;

a sleeve disposed in the coring bit, wherein the sleeve receives at least a portion of a core sample of the formation resulting from extension of the coring bit into the formation; and a transporter comprising:

a shoe having a protrusion; and a handling piston to extend the shoe through the static sleeve, thereby pushing the core sample out of the sleeve such that the protrusion simultaneously marks the core sample.

2. The apparatus of claim 1 wherein the downhole coring tool comprises:

a first motor operable to rotate the coring bit; and a second motor operable to extend the coring bit into the subterranean formation through a sidewall of the borehole.

3. The apparatus of claim 2 wherein the downhole coring tool further comprises:

a pinion driven by the first motor; and a gear drive driven by the pinion and engaging the coring bit thereby imparting rotation to the coring bit.

4. The apparatus of claim 3 wherein an external surface of the gear drive engages the pinion, and wherein an internal surface of the gear drive engages the coring bit.

5. The apparatus of claim 3 wherein the coring bit comprises an exterior key member, and wherein the internal surface of the gear drive engages the key member.

6. The apparatus of claim 5 wherein the gear drive, key member, pinion and first motor are coupled to the housing to collectively pivot in unison with the housing.

7. The apparatus of claim 1 wherein the protrusion has a ridge shape.

8. The apparatus of claim 1 wherein the protrusion has a knife shape.

9. The apparatus of claim 1 wherein the protrusion has a finger shape.

10. The apparatus of claim 1 wherein the protrusion has a stylus shaped.

11. The apparatus of claim 1 wherein the protrusion has a tetrahedron shape.

12. The apparatus of claim 1 wherein the protrusion has a pyramid shape.

13. The apparatus of claim 1 wherein the sleeve comprises a static sleeve rotationally independent of the coring bit.

14. The apparatus of claim 13 wherein the static sleeve comprises an additional protrusion extending radially inward toward the core sample sufficiently to mark the core sample.

15. The apparatus of claim 14 wherein the additional protrusion is one of a plurality of additional protrusions each extending radially inward into contact with the core sample sufficiently to mark the core sample, wherein ones of the plurality of additional protrusions are differently shaped.

16. The apparatus of claim 15 wherein the static sleeve has a first end proximate a cutting end of the coring bit and a second end distal from the cutting end of the coring bit, wherein at least one of the plurality of additional protrusions is located proximate the first end of the static sleeve, and wherein at least one of the plurality of additional protrusions is located proximate the second end of the static sleeve.

17. The apparatus of claim 1 wherein the protrusion comprises a tip disposed on a surface of the shoe and offset from a center of the shoe.

18. The apparatus of claim 1 wherein the protrusion comprises a sharp point configured to indent a mark on the core sample.

19. The apparatus of claim 1 wherein the shoe comprises a plate disposed on an end of the handling piston.

20. The apparatus of claim 1 wherein the transporter is configured to transport the core sample from the static sleeve to a storage column disposed within the downhole coring tool.

* * * * *